US011191310B2

(12) United States Patent
Carter et al.

(10) Patent No.: US 11,191,310 B2
(45) Date of Patent: Dec. 7, 2021

(54) SMOCK

(71) Applicant: Bob Barker Company, Inc., Fuquay-Varina, NC (US)

(72) Inventors: Lonny Langston Carter, Raleigh, NC (US); Lena Renee Butterfield, Apex, NC (US)

(73) Assignee: BOB BARKER COMPANY, INC., Fuquay-Varina (NO)

( * ) Notice: Subject to any disclaimer, the term of this patent is extended or adjusted under 35 U.S.C. 154(b) by 102 days.

(21) Appl. No.: 16/420,270

(22) Filed: May 23, 2019

(65) Prior Publication Data

US 2019/0357607 A1 Nov. 28, 2019

Related U.S. Application Data

(60) Provisional application No. 62/675,961, filed on May 24, 2018.

(51) Int. Cl.
*A41D 13/12* (2006.01)
*A41D 13/04* (2006.01)

(52) U.S. Cl.
CPC ..... *A41D 13/1245* (2013.01); *A41D 13/04* (2013.01); *A41D 13/129* (2013.01); *A41D 2300/326* (2013.01)

(58) Field of Classification Search
CPC .. A41D 13/1245; A41D 13/129; A41D 13/04; A41D 2300/33; A41D 2300/30; A41D 2300/326; A41D 3/00; A41D 7/008; A41D 10/00; A41D 11/00; A41D 13/1272; A41D 2400/70; A41B 2300/30; A41B 13/00; A41B 13/06; A41B 13/08; A41B 13/10
USPC ..... 2/48, 52, 70, 83, 69.5
See application file for complete search history.

(56) References Cited

U.S. PATENT DOCUMENTS 1,810,027 A * 6/1931 Moran ..... G02C 5/045 24/17 R
D139,947 S * 1/1945 Saponoff ..... A41F 1/00 D2/627
2,367,383 A * 1/1945 Tiscornia ..... A41B 13/103 2/49.3
D149,092 S * 3/1948 Seidenbaum ..... D2/861
2,501,010 A * 3/1950 Seidenbaum ..... A41B 13/10 2/48
2,638,598 A * 5/1953 Abramson ..... A41B 13/00 2/75

(Continued)

FOREIGN PATENT DOCUMENTS

GB 306595 A * 2/1929 ..... A47K 10/02
GB 423627 A * 2/1935 ..... A41D 13/04

OTHER PUBLICATIONS alibaba.com, "Smock Apron, Smock for Kids, Cobbler Apron", pp. 1-12, retrieved on May 22, 2019, retrieved from internet: https://www.alibaba.com/product-detail/SMOCK-APRON-SMOCK-FOR-KIDS-COBBLER_60271492879.html.

(Continued)

*Primary Examiner* — Amy Vanatta
(74) *Attorney, Agent, or Firm* — Coats & Bennett, PLLC

(57) ABSTRACT

An adjustable smock that facilitates attachment and detachment from a person. The smock includes a body with one or more adjustable tabs. The tabs extend outward from the body and are configured to be inserted into a corresponding receptacle along an opposing section of the body.

17 Claims, 11 Drawing Sheets

(56) References Cited

U.S. PATENT DOCUMENTS

| | | | | |
|---|---|---|---|---|
| 3,397,406 | A * | 8/1968 | Leach | A41F 1/00 2/96 |
| 5,011,334 | A * | 4/1991 | Vorhauer | B63C 11/08 2/16 |
| 8,307,462 | B1 * | 11/2012 | Purcaro | A41D 13/04 2/48 |
| 8,707,467 | B2 * | 4/2014 | Sohn | A41D 1/215 2/104 |
| 2002/0152535 | A1 * | 10/2002 | Gaza | A41D 13/129 2/114 |
| 2010/0017929 | A1 * | 1/2010 | Kenney | A41D 13/04 2/49.1 |
| 2010/0313327 | A1 * | 12/2010 | Anscher | A44B 11/266 2/102 |
| 2012/0185993 | A1 * | 7/2012 | Cohen | A41D 3/08 2/69 |
| 2013/0276202 | A1 * | 10/2013 | Forbes | A41D 13/1236 2/114 |
| 2020/0323293 | A1 * | 10/2020 | Choudhury | A41D 13/1254 |

OTHER PUBLICATIONS

Charm-Tex, "Blue Self Protection Smock-Fully Closed", pp. 1-3, retrieved on May 22, 2019, retrieved from internet: https://www.charm-tex.com/suicide-prevention/smock-gowns/blue-self-protection-smock-fully-closed.html.

alibaba.com, "Smock Apron, Smock for Kids, Cobbler Apron—Buy Smock Apron, Smock for Kids, Cobbler Apron", pp. 1-7, retrieved on May 22, 2019, retrieved from internet: https://www.alibaba.com/product-detail/SMOCK-APRON-SMOCK-FOR-KIDS-COBBLER_60271492879.html.

* cited by examiner

SMOCK

RELATED APPLICATIONS

This claims priority to U.S. Provisional Application No. 62/675,961, filed May 24, 2018, the disclosure of which is incorporated herein by reference in its entirety.

BACKGROUND

It is common for institutional facilities such as but not limited to jails, juvenile detention centers, and prisons to provide clothing for their inmates. The clothing may be for short-term use, such as when a person is initially charged with an offense, or may be more long-term, such as a prisoner serving an extended incarceration term.

The clothing should be designed to fit a wide variety of inmates. Designs that are configured to accommodate a wide-range of body shapes and sizes reduce the amount of different clothing inventory that the facility is required to keep in stock.

The clothing should be designed to prevent its use as a weapon. This may include the clothing being used by the inmate to injure themselves, and also from being used to injure another person such as an inmate or guard. Attached components, such as but not limited to buttons, hook-and-loop fasteners, zippers, cords, toggles, plastic or metal snaps, and hook-and-eye closures may be removed and used as a weapon.

SUMMARY

One aspect is directed to a smock that includes a body with a top side, an opposing bottom side, and lateral sides. The smock also includes one or more tab and receptacle combinations. Each combination includes: a tab that extends outward from the body and that includes an arm and a wing that extends outward from the arm with the tab having a first size at the wing and a second size away from the wing; and a receptacle sized to receive the tab and being positioned on an opposing part of the body from the tab with the receptacle being smaller than the first size and larger than the second size.

In another aspect, the wing is a first wing and the tab further includes one or more additional wings each sized greater than the receptacle.

In another aspect, the wing includes a first section that extends outward from a first side of the arm and a second section that extends outward from an opposing second side of the arm.

In another aspect, each of the first section and the second section include a common shape and size and the wing is symmetrical about a centerline of the arm.

In another aspect, the wing includes a tapered shape that requires a first amount of force to be inserted into the receptacle and a greater second amount of force to be removed from the receptacle.

In another aspect, the body and the one or more tab and receptacle combinations include a unitary construction.

In another aspect, the body includes first and second sections that are connected together along a seam.

In another aspect, the smock is flat in an open orientation.

In another aspect, a first pair of the tab and receptacle combinations are positioned along the top side of the body and form shoulder straps.

In another aspect, the body further includes an enclosed opening sized to receive a head of a user.

In another aspect, a fixed shoulder strap is positioned at the top side of the body with the fixed shoulder strap being non-adjustable.

One aspect is directed to a smock that includes a body with a top side, a bottom side, and lateral sides, and tabs that each includes an arm and one or more wings that extend laterally outward from the arm with the wings comprising a tapered shape. Receptacles are positioned at the body and each is sized to receive one of the tabs. The tabs are configured to require a first amount of force to be inserted into the receptacle and a second amount of force to be removed from the receptacle. The second amount of force is greater than or equal to the first amount of force.

In another aspect, the smock is selectively positionable between a first orientation when not worn by a user and a second orientation when worn by the user. The first orientation includes a flat shape with the tabs positioned away from the receptacles. The second orientation includes a first one of the tabs inserted into a first one of the receptacles to form a first shoulder strap, a second one of the tabs inserted into a second one of the receptacles to form a second shoulder strap, and a third one of the tabs inserted into a third one of the receptacles to form a lateral strap.

In another aspect, each of the receptacles includes a width that is greater than the arm and that is less than the one or more wings.

One aspect is directed to a method of using a smock. The method includes wrapping a flexible body around a user with the body including a tab and a corresponding receptacle with the tab extending outward from the body and the receptacle being spaced away from the tab. The method includes aligning the tab with the receptacle. The method includes applying a first force to the tab and inserting the tab into the receptacle with a wing on the tab moving through the receptacle and the tab forming a strap along one side of the body and securing the body to the user. The method includes applying a second force to the tab that is greater than or equal to the first force and contacting a back of the wing against a back of the receptacle and preventing the tab from being removed from the receptacle. The method includes applying a third force to the tab that is greater than the second force and deforming the wing and pulling the tab out of the receptacle and disconnecting the tab from the receptacle.

In another aspect, the method also includes deforming the wing on the tab and reducing a width of the tab while moving the tab through the receptacle.

In another aspect, the method also includes contacting a back edge of the wing against the back of the receptacle and preventing the tab from being removed from the receptacle.

In another aspect, the method also includes positioning an enclosed neck opening around a neck of the user prior to inserting the tab into the receptacle.

In another aspect, the method also includes aligning the tab with a shoulder of the user and forming a shoulder strap with the tab.

In another aspect, the tab is a first tab and the receptacle is a first receptacle. The method further includes: inserting a second tab into a second receptacle and forming a second strap along a second side of the body; and inserting a third tab into a third receptacle and forming a third strap.

One aspect is directed to a smock that includes a body with first and second sections. A first pair of shoulder tabs extends outward from a top of one of the first and second sections. Each of the tabs has one or more wings. A first pair of receptacles is positioned on the other of the first and second sections and each has a receptacle. One or more lateral tabs extend outward from a lateral side of one of the first and second sections. Each of the one or more lateral tabs has one or more wings. A least one receptacle is positioned on the other of the first and second sections and are sized to receive the one or more lateral tabs.

In one aspect, extensions extend outward from the top of the other of the first and second section with each of the extensions including one of the receptacles.

In one aspect, the first and second sections are connected together along a seam.

In one aspect, the body is flat when not worn by a user.

In one aspect, the smock includes two or more lateral tabs that are identical.

In one aspect, the shoulder tabs are identical.

In one aspect, each of the shoulder tabs and lateral tabs include wings that include a width that is larger than the receptacles.

In one aspect, the body is constructed from a single piece of material.

One aspect is directed to a smock that includes a body. Shoulder tabs extend outward from a top side of the body. At least one lateral tab extends outward from a lateral side of the body. Each of the tabs includes a central arm and one or more wings extending along a length of the arm. Receptacles are positioned at the top side and lateral side of the body and each includes an opening sized to receive one of the tabs. The receptacles include a width that is larger than the central arm and smaller than the wings.

One aspect is directed to a method of securing a smock on a user. The method includes: inserting a first tab into a first receptacle and forming a first shoulder strap; inserting a second tab into a second receptacle and forming a second shoulder strap; forming an enclosed neck between the first and second shoulder straps; inserting a third tab at a first lateral side into a third receptacle on an opposing second lateral side.

In one aspect, the method also includes inserting a fourth tab at the first lateral side into a fourth receptacle on the opposing second lateral side.

In one aspect, the method also includes reducing a width of one or more wings on the each of the tab while inserting the tabs into the respective receptacles.

DETAILED DESCRIPTION

The present application is directed to an adjustable smock. The smock includes a body with one or more adjustable tabs. The tabs extend outward from the body and are configured to be inserted into a corresponding receptacle along an opposing section of the body. The number of tab and receptacle combinations can vary.

In one example, each of the tabs includes an arm and one or more wings. The tabs are configured to require a first amount of force to be inserted into the corresponding receptacle, and a second force that is greater than or equal to the insertion force to be removed from the receptacle. In one example, the force to remove the tab is greater than the force to insert the tab. In one example, the wings are configured to be reduced in sized to be moved through the receptacle.

Figure 1:
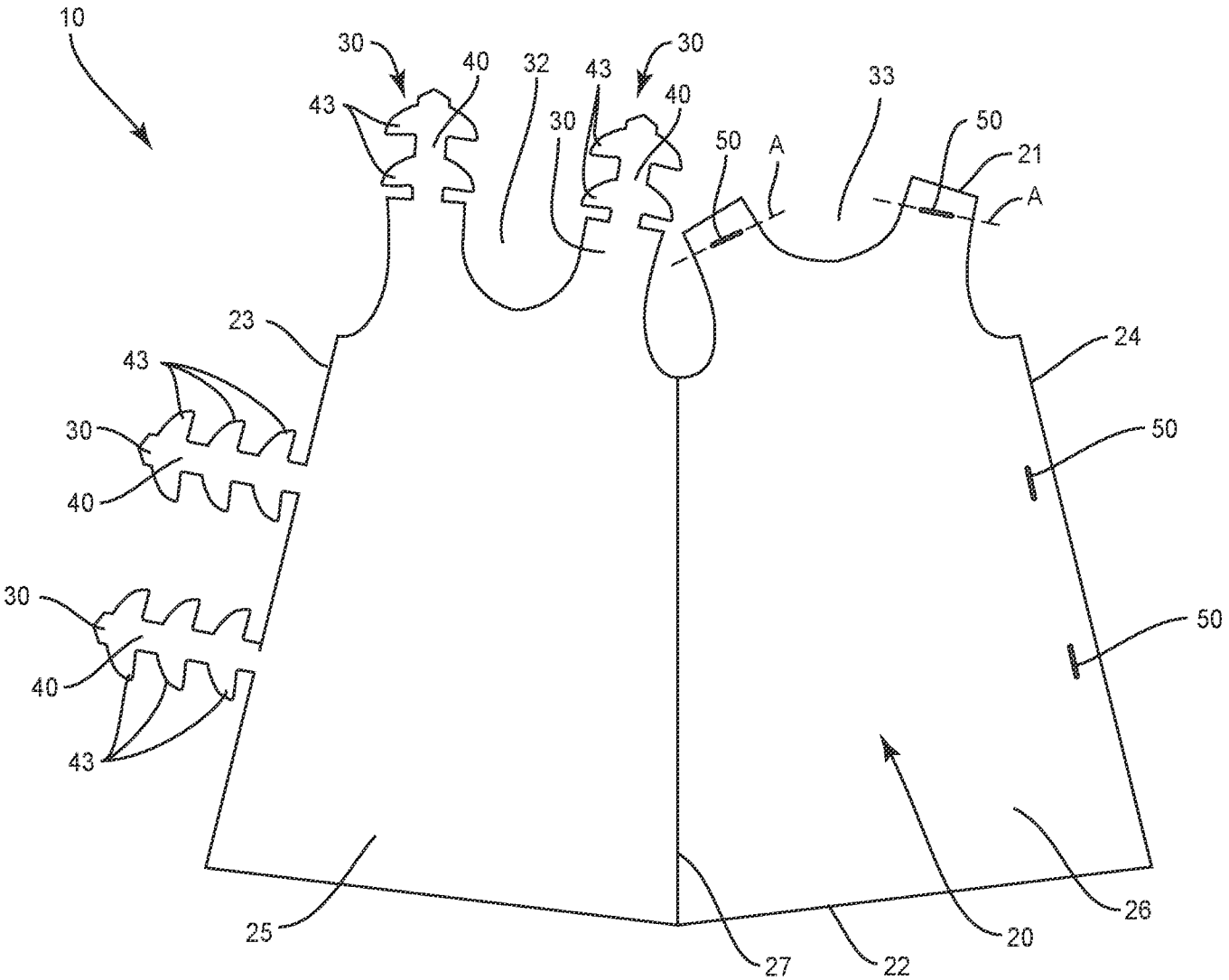
FIG. 1 is a plan view of a smock in an open orientation.

FIG. 1 illustrates a smock 10 in an open configuration prior to being worn by a user. The smock 10 includes a unitary construction. The unitary construction can include a single piece of material, or two or more separate pieces that are fixedly attached together to form the unitary construction. The different pieces can be secured together in a variety of different methods, such as but not limited to stitching.

In one example, the smock 10 includes a body 20 constructed from a single piece of material. In another design as illustrated in FIG. 1, the body 20 is constructed from a first section 25 and a second section 26. The two sections 25, 26 are separate pieces and connected together along a seam 27 that extends between a top side 21 and a bottom side 22. The seam 27 can be constructed in various sewing/stitching manners, including a double needle stitch. The first section 25 forms one of the front and back sides of the smock 10, and the second section 26 forms the opposing side. As illustrated in FIG. 1, the smock 10 can be constructed to be flat in the open configuration.

The smock 10 can be constructed from a variety of different materials. Examples of materials include but are not limited to polyester, cotton, felt, nylon, and foam. One specific design includes a 650 denier polyester with a 10 oz. polyester batting.

The body 20 includes a top side 21, a bottom side 22, and opposing first and second lateral sides 23, 24. One or more tabs 30 extend from the body 20. FIG. 1 includes a pair of tabs top side 21. FIG. 1 includes a pair of tabs 30 extending from the top side 21 and that are spaced apart on opposing sides of a first neck section 32. Each tab 30 includes a corresponding receptacle 50 to receive the tab 30. As illustrated in FIG. 1, the tabs 30 and first neck section 32 can be positioned along the first section 25, and the receptacles 50 and second neck section 33 can be positioned along the second section 26. In the example of FIG. 1, the receptacles 50 have an elongated shape with a major axis A that extends along the top side 21 of the body 20. When the smock 10 is folded along the seam 27 such as when worn by a user, a first one of the tabs 30 is positioned to connect to a corresponding first one of the receptacles 50 to form a first shoulder strap. A second one of the tabs 30 is positioned to connect to a corresponding second one of the receptacles 50 to form a second shoulder strap. The first and second neck sections 32, 33 align together and form a single contained neck opening.

Each tab 30 is configured to engage with a corresponding receptacle 50. The number of tab 30 and receptacle 50 combinations can vary. The tabs 30 can include a variety of different shapes and sizes. The tabs 30 can include sections that have different sizes for selective engagement with the receptacles 50. The sizes can vary in one or more different dimensions, such as different sizes of widths along the tabs 30 and/or thickness.

Figure 2:
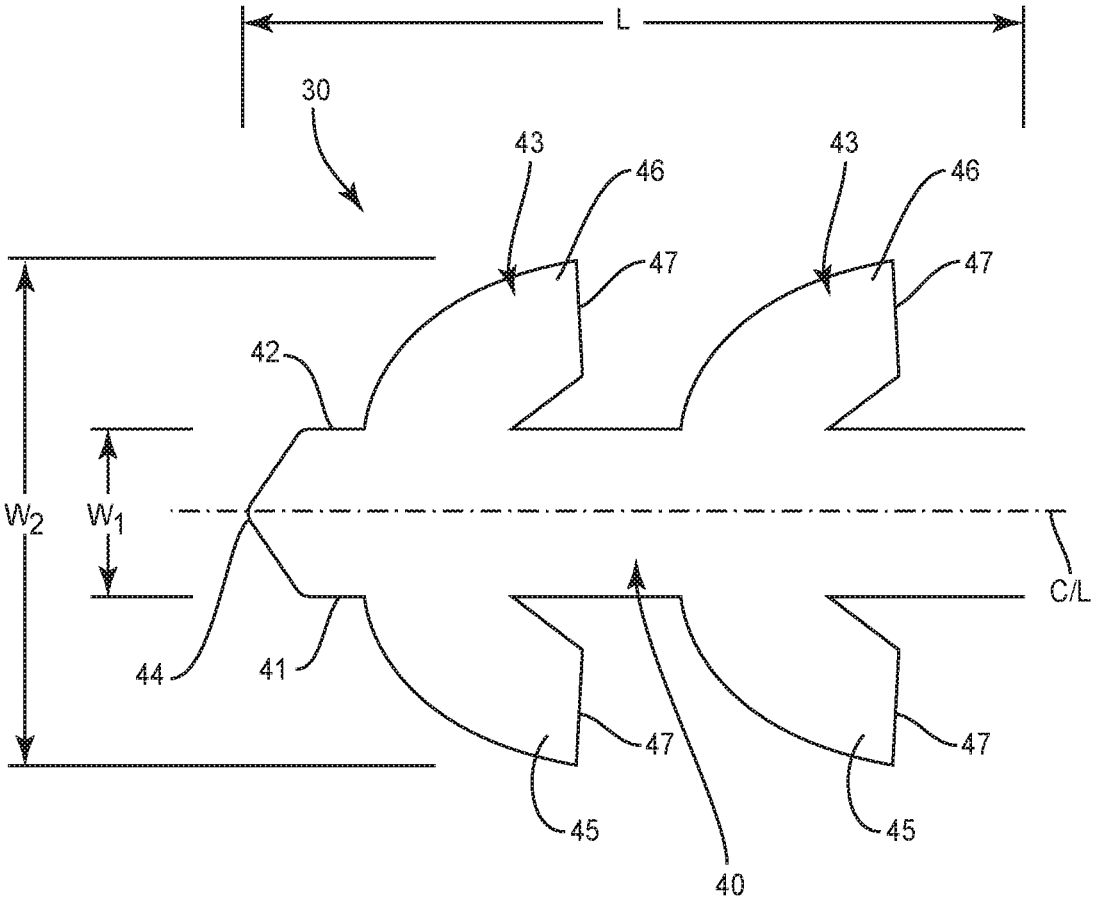
FIG. 2 is a plan view of a tab.

FIG. 2 includes a tab 30 that includes an arm 40 with a centerline C/L. The arm 40 includes opposing sides 41, 42 and has a width $W_1$ measured between the sides 41, 42. A tip 44 of the arm 40 is exposed for inserting into the receptacle 50. The tip 44 can include a tapered shape to facilitate the insertion. The arm 40 includes a length L measured along the centerline C/L that extends inward from the tip 44 to a point that engages with the body 20.

One or more wings 43 are positioned along the length L of the arm 40. The wings 43 extend outward from one or both sides 41, 42 of the arm 40. FIG. 2 includes each wing 43 having a first section 45 that extends outward from the first side 41 of the arm 40 and a second section 46 that extends outward from the second side 42 of the arm 40. The wings 43 include a tapered shape along the length L with a width $W_2$ measured between the outer edges of the first and second sections 45, 46. The tapered shape results in the width $W_2$ being narrower towards the tip 44 and flaring outward and having an enlarged width at a back side 47. Each of the first and second sections 45, 46 includes a back side 47 that faces away from the tip 44. The back sides 47 can be aligned at various angles relative to the centerline C/L, including being perpendicular to the centerline C/L as illustrated in FIG. 2.

FIG. 2 includes each of the wings 43 being symmetrical about the centerline C/L. The first and second sections 45, 46 have the same shape and size. Other examples can include wings 43 being non-symmetrical about the centerline C/L.

Figure 3:
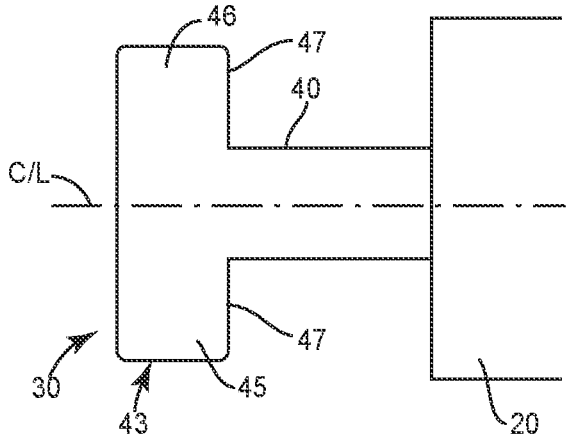
FIG. 3 is a plan view of a tab.
Figure 4:
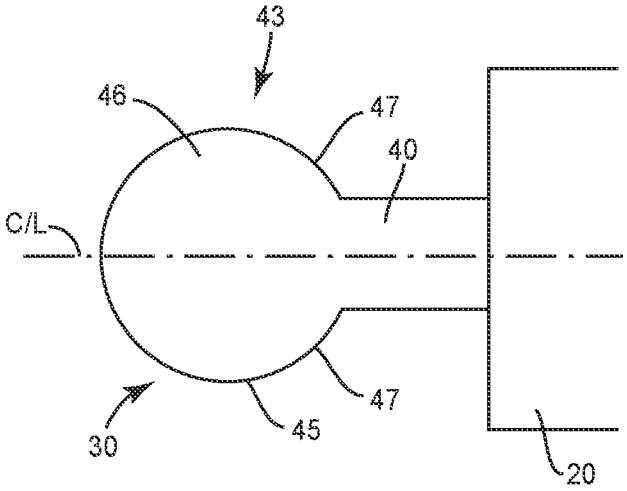
FIG. 4 is a plan view of a tab.
Figure 5:
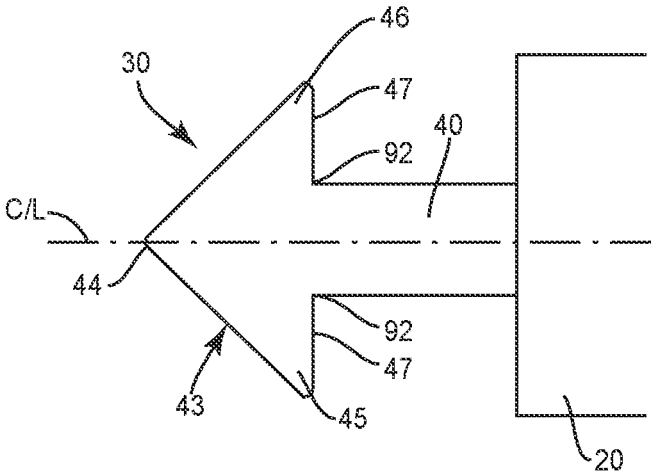
FIG. 5 is a plan view of a tab.

FIG. 3 includes a wing 43 positioned at the end of the arm 40. The wing 43 includes a symmetrical shape about the centerline C/L with each of the first and second wing sections 45, 46 including the same shape and size. FIG. 4 includes a wing 43 with a circular shape. FIG. 5 includes a wing 43 with an arrow shape that tapers in width towards and forms a narrow tip 44. As further illustrated in FIG. 5, the back sides 47 of the tab 30 intersect with the arm 40 at corners 92. In one or more examples such as FIGS. 3 and 5, the back edge 47 of the tab 30 is straight.

Figure 6:
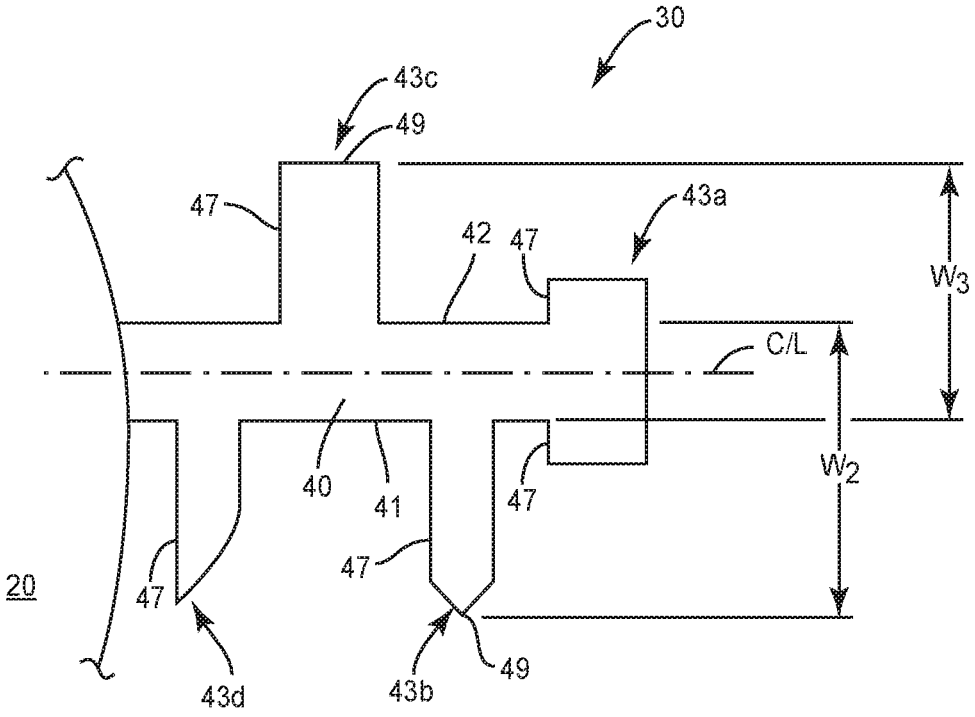
FIG. 6 is a plan view of a tab.

FIG. 6 includes a tab 30 with four wings 43*a*-43*d*. A first wing 43*a* is positioned at an end of the arm 40 and includes a symmetrical shape about the centerline C/L. Wings 43*b*, 43*c*, 43*d* are spaced inward from the first wing 43*a* and extend along the arm 40. Each of these wings 43*b*, 43*c*, 43*d* extends outward from just one of the sides 41, 42 of the arm 40. The different wings 43*b*, 43*c*, 43*d* include different shapes and sizes. The width of the tab 30 is greater at the wings 43*a*-43*d* than away from the wings 43*a*-43*d*. For example, the width $W_2$ of wing 43*b* extends from the side 42 of the arm to the tip 49. The width $W_3$ of wing 43*c* extends from side 42 to the tip 49. Each of these widths is greater than a width of just the arm 40.

Figure 7:
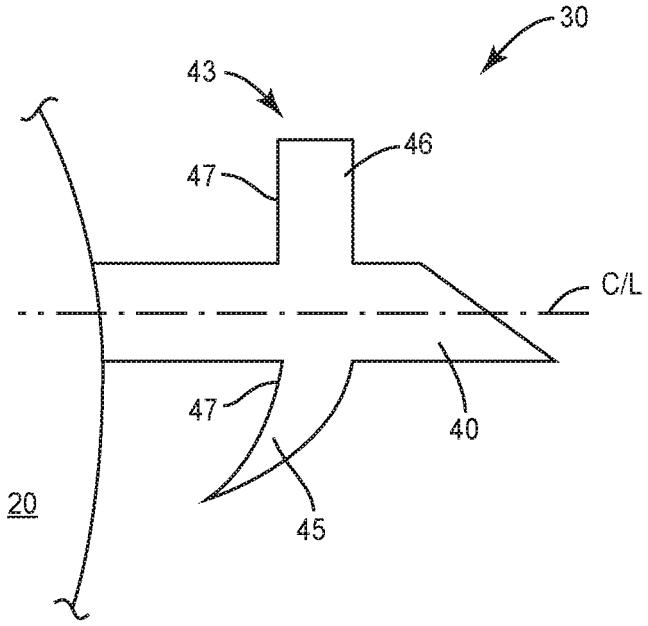
FIG. 7 is a plan view of a tab.

FIG. 7 includes a tab 30 with a wing 43 having a non-symmetrical shape about the centerline C/L. The first and second sections 45, 46 of the wing 43 include different shapes and sizes.

Figure 14:
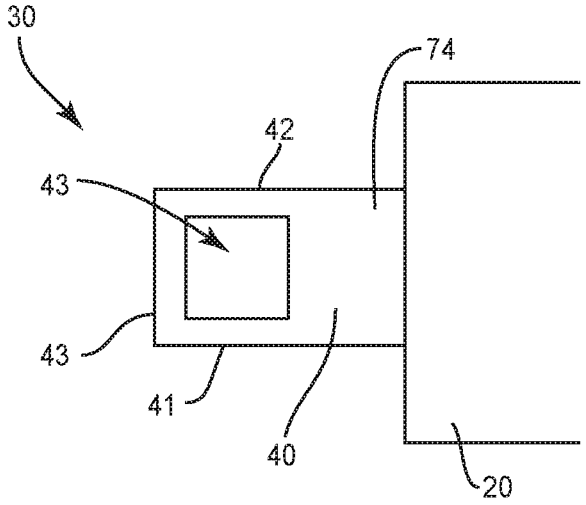
FIG. 14 is a plan view of a tab.
Figure 14A:
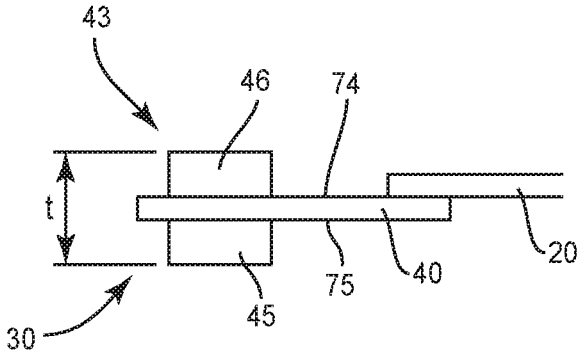
FIG. 14A is a side view of the tab of FIG. 14.

As illustrated in FIGS. 2-7, the different sizes of the sections of the tabs 30 can include differences in a width of the tab 30. The differences in sizes can also include different thicknesses. FIGS. 14 and 14A include a tab 30 that is attached to and extends outward from a body 20. The tab 30 includes an arm 40. A wing 43 is positioned on the arm 40 and extends outward from a top side 74 and a bottom side 75. The wing 43 includes a thickness t that is larger than the thickness of the arm 40. This difference in sizes of the different sections of the tab 30 provide for engaging the corresponding receptacle 50. In another example, the wing 43 extends outward from just one side of the arm 40 (e.g., from just the top side 74).

In one example, one or more tabs 30 include size differences in both width and thickness.

The various wings 43 can include a back side 47 that contacts against the body 20 adjacent to the receptacle 50 when the tab 30 is being pulled out of the receptacle 50. The back side 47 can be shaped to require a larger force to remove the tab with the wing 43 from the receptacle 50. For example, the back sides 47 of FIGS. 3 and 5 are shaped to require a larger amount of force than the back sides 47 of FIG. 4 to remove the tap from the corresponding receptacle 50. In these Figures, the back sides 47 are the same along each of the sections 45, 46. In another example, the sections 45, 46 include back sides 47 with different shapes and/or sizes. The back sides 47 can be transverse to the centerline C/L of the arm 40. In one example, the back sides 47 are perpendicular to the centerline C/L.

The smock 10 can include one or more tab 30 and receptacle 50 combinations. The tabs 30 extend outward from and can be positioned at various locations on the body 20. FIG. 1 includes tabs 30 extending outward from the top side 21 and lateral side 23 of the body 20. FIG. 1 illustrates a design with a pair of tabs 30 at the first lateral side 23. Other designs can include one tab 30, or more than two tabs 30. In the various examples, each of the tabs 30 includes one or more wings 43 that are shaped and sized as explained above.

The receptacles 50 are sized and shaped to receive the tabs 30. As illustrated in FIG. 1, receptacles 50 can be spaced apart along a top side 21 of the smock 10 to receive corresponding tabs 30 to form shoulder straps. Receptacles 50 can also be positioned along one or more lateral sides 23, 24 to receive corresponding tabs 30 to form closures at the lateral sides of the smock 10. In one example as illustrated in FIG. 1, each tab 30 and receptacle 50 combination includes a single receptacle 50. Other designs (e.g., FIG. 9) can include combinations with more than one receptacle 50 at one or more of the locations. The multiple receptacles 50 at a location can provide for sizing the smock 10 as necessary to fit the user. For example, a receptacle 50 in closer proximity to the lateral side of the smock 10 can be used for a larger user, while a receptacle 50 spaced inward from the lateral side can be used for a smaller user.

The receptacles 50 can include various shapes, sizes, and constructions. As illustrated in FIG. 1, the receptacles 50 can be slits that extend through the smock 10. The receptacles 50 include a width that is greater than a width of the tab 30 away from the wings 43, and less than a width $W_2$ of the tab 30 at the wings 43. In one example, one or more receptacles 50 include a width that is less than the width of the tab 30 away from the wings 43.

The tabs 30 are configured to require a first amount of force to be inserted into the receptacles 50. A second amount of force is required to remove the tabs 30 from the receptacles 50. The second amount of force is greater than or equal to the first amount of force. In one example, the amount of force to remove the tabs 30 from the receptacles 50 is greater than the amount to insert the tabs 30 into the receptacles 50.

In one example, the width of the tabs 30 away from the wings 43 is less than the width of the receptacles 50. During movement of the tab 30 through the receptacle 50, the section of the tabs 30 away from the wings 43 are sized to not deform. In one example, these sections include sections of the tabs 30 that include just the arm 40. In another example, the tabs 30 away from the wings 43 include a width that is greater than the receptacles 50 and thus deform during movement through the receptacles 50.

The width of the tabs 30 at the wings 43 is greater than the width of the receptacles 50. Therefore, the wings 43 and/or arms 40 deform during movement through the receptacles 50.

The tabs 30 can be constructed from a material that can be deformed to reduce the width to enable passing through the receptacle 50. The arms 40 and wings 43 can be constructed from the same or different materials. Further, different wings 43 along an arm 40 can be constructed from the same or different materials.

In one example after the tabs 30 are inserted into the receptacles 50, the tabs 30 return to their original shape with the width being larger than the receptacle 50 to prevent the tabs 30 from moving out of the receptacles 50. The back sides 47 of the wings 43 can contact the smock 10 on one or both sides of the receptacles 50 to prevent inadvertent removal such as when the smock 10 is being worn during normal use. In the event an excess amount of force is applied to the tabs 30 (such as if the smock 10 was used to hurt the user or another person), the wings 43 are configured to deform and move through the receptacles 50 thus release the tabs 30 from the receptacles 50.

In one example, the width $W_1$ of the arms 40 can be larger than the receptacles 50. During insertion, the arms 40 are deformed inward to reduce the width to allow for passage through the receptacles 50.

The different tab 30 and receptacle 50 combinations can include the same or different amounts of force for insertion and/or removal. In one example, each combination is the same and requires the same forces. Another example includes the different combinations requiring different forces for insertion and/or removal. In one example, a first combination that forms a shoulder strap can require a first amount of force to remove the tab 30 from the receptacle 50, and a second combination that forms a lateral strap can require a different second amount of force to remove the tab 30 from the receptacle 50.

Figure 8:
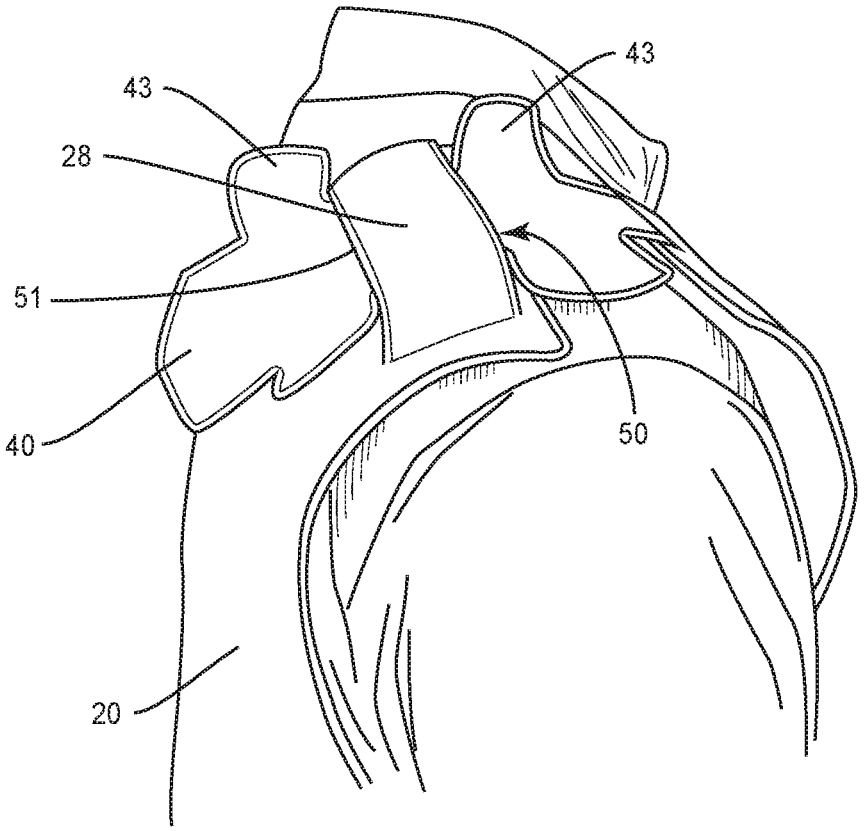
FIG. 8 is a perspective view of a tab inserted into a receptacle and forming a shoulder strap along a top side of a body of a smock.

The receptacles 50 can include various constructions. As disclosed above, one or more of the receptacles 50 can include slits. One or more of the receptacles 50 can also be formed by straps 28. As illustrated in FIG. 8, the strap 28 includes an elongated shape with opposing ends that are secured to the body 20. A gap 51 is formed between the strap 28 and the body 20. The tab 30 is sized to fit into the gap 51 during insertion and removal. In one example, the width of the gap 51 measured between the two secured ends is less than the width of the tab 30 at one or more of the wings 43 to prevent the tab 30 from inadvertently backing out of the receptacle 50.

Figure 9:
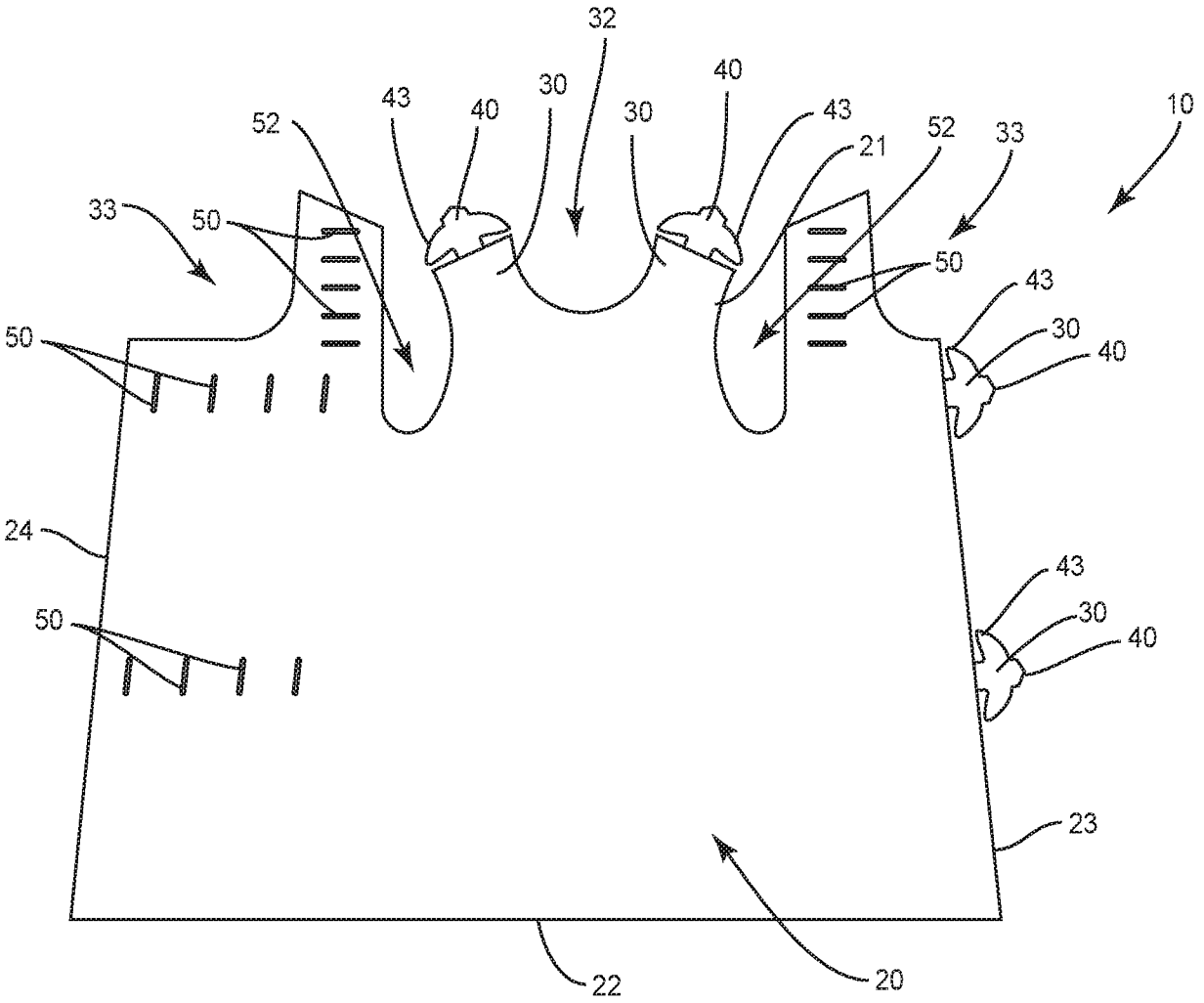
FIG. 9 is a plan view of a smock in an open orientation.

FIG. 9 illustrates another example of a smock 10 in an open configuration. The smock 10 is constructed in a manner to lie flat in the open configuration. A main section of the smock 10 forming the front and back of the garment is formed from a single piece of material. In one example, tabs 30 are separate elements that are connected to the single piece. In another example, the tabs 30 are constructed from the same single piece of material.

The smock 10 includes tabs 30 that extend outward from the top side 21 and first lateral side 23. The tabs 30 each include an arm 40 with a single wing 43. The tabs 30 along the top side 21 are spaced apart on opposing sides of the first neck section 32. Receptacles 50 are positioned along the smock 10 to receive the tabs 30. The receptacles 50 along the top side 21 are spaced laterally outward on the material piece from each of the corresponding tabs 30. The spacing 52 between each of the tabs 30 and receptacles 50 forms an opening for the user's shoulder when the smock 10 is worn by the user.

In the example of FIG. 9, the receptacles 50 are aligned in a straight row that extends inward from an outer side of the smock 10. This positioning provides for adjusting the size of the smock 10 to accommodate the user. The spacing between the receptacles 50 in each row can vary.

Figure 10:
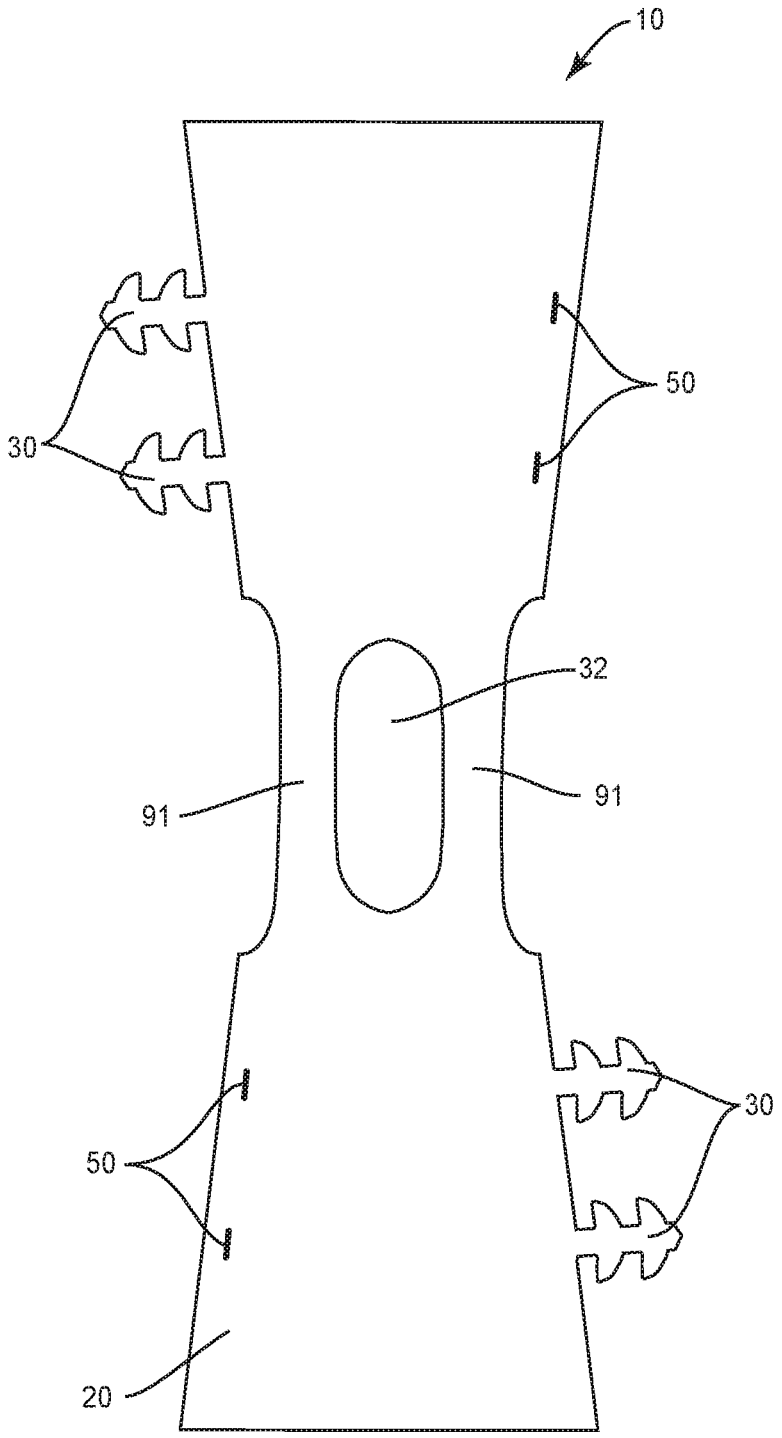
FIG. 10 is a plan view of a smock in an open orientation.

FIG. 10 includes a smock 10 with an enclosed neck section 32 positioned between opposing shoulder straps 91. The body 20 further includes main sections that are designed to be positioned along the front and backs of the user. Tabs 30 extend outward from the body 20 and each is configured to engage with a corresponding receptacle 50 on an opposing part of the body 20.

Figure 11:
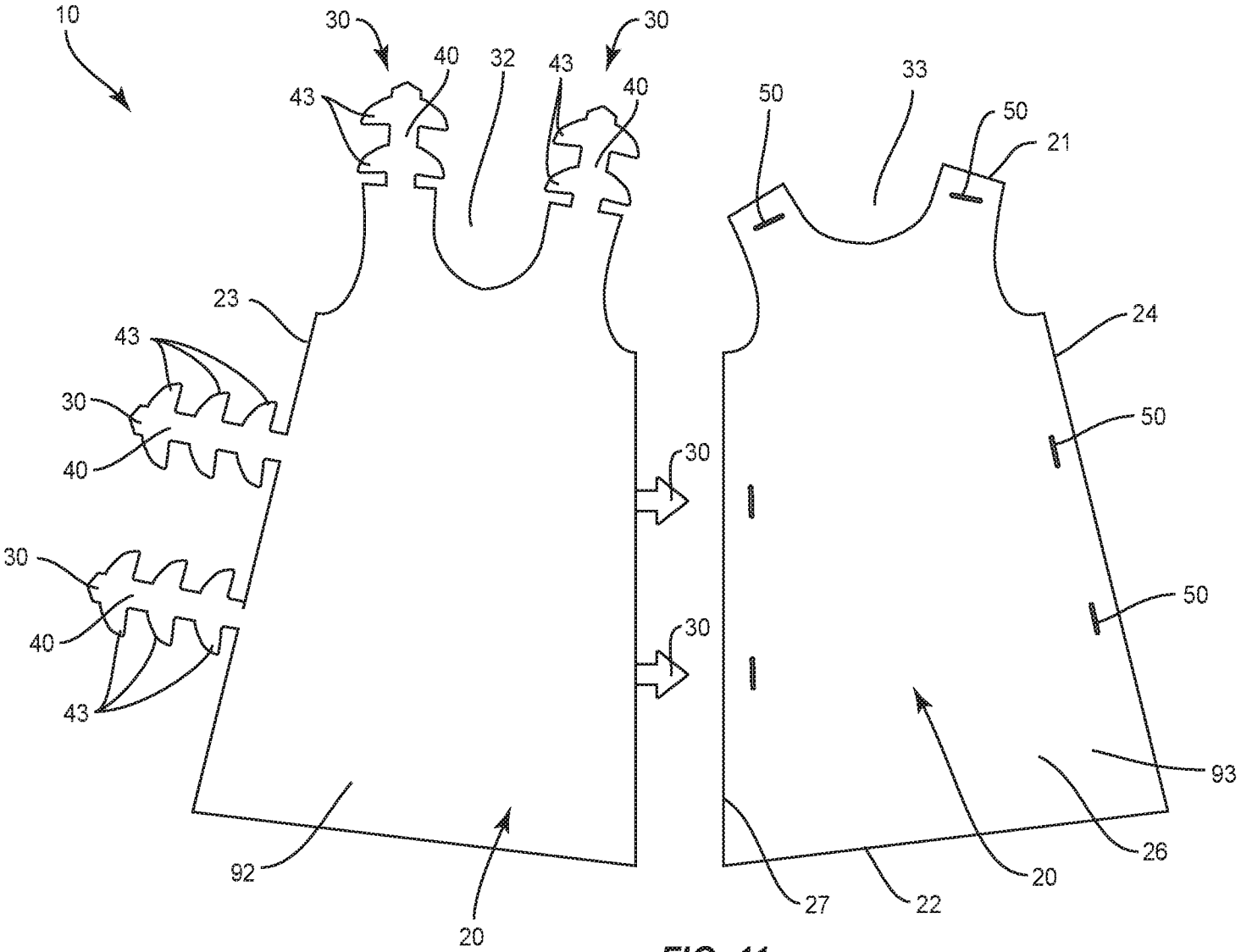
FIG. 11 is a plan view of a smock in an open orientation.

The smock 10 can have a single, unitary construction as illustrated in FIG. 1. The smock 10 can also be constructed from multiple different pieces that can be connected together. FIG. 11 includes an example with a smock 10 that includes a first piece 92 and a second piece 93. In this example, the first piece 92 includes tabs 30 and the second piece 93 includes corresponding receptacles 50. The tabs 30 are configured to align with and engage the receptacles 50 to complete the smock 10 for wearing by the user.

Figure 12:
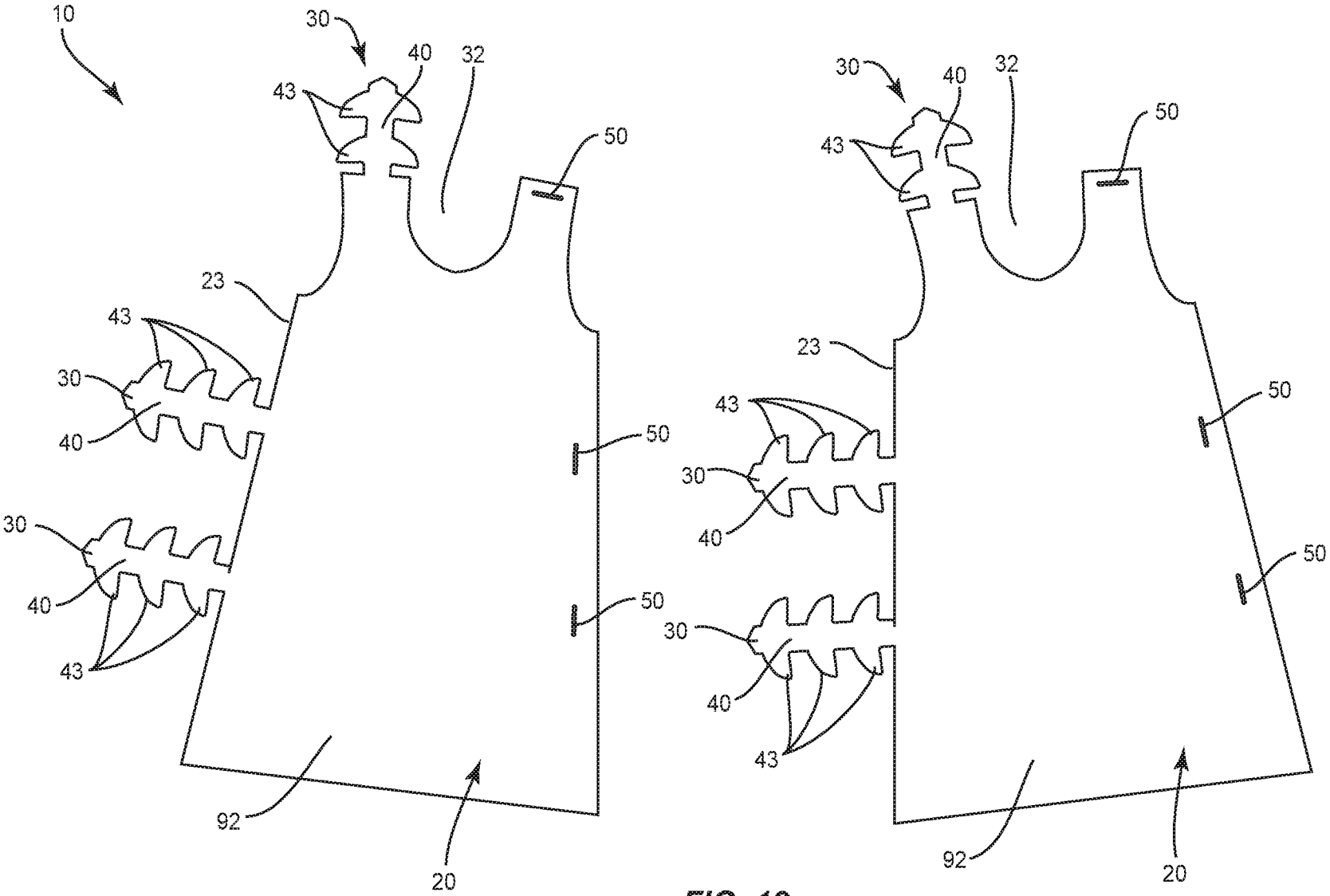
FIG. 12 is a plan view of a smock in an open orientation.

FIG. 12 includes a smock 10 formed from pieces 92 that have a common design of tabs 30 and receptacles 50. The design provides for complementary tabs 30 and receptacles 50 when positioned on opposing sides of the user. This layout provides for two pieces of the same design to mate together to form a smock 10. In one example, the two pieces 92 are identical in shape and size. Other examples include differences in various shapes and/or sizes, such as differences in the shapes and/or sizes of the bodies 20.

The smock 10 is configured to be secured to a user in a straight-forward manner. The smock 10 is further configured to be placed on a user by another person, such as security guard or police officer. The smock 10 does not include components such as buttons, zippers, and hook-and-loop fasteners that could be removed from the smock 10 to injure the user or another person. Further, the smock 10 does not include enclosed openings that are fixed in which the user could place their head in an attempt to injure themselves or another.

Figure 13:
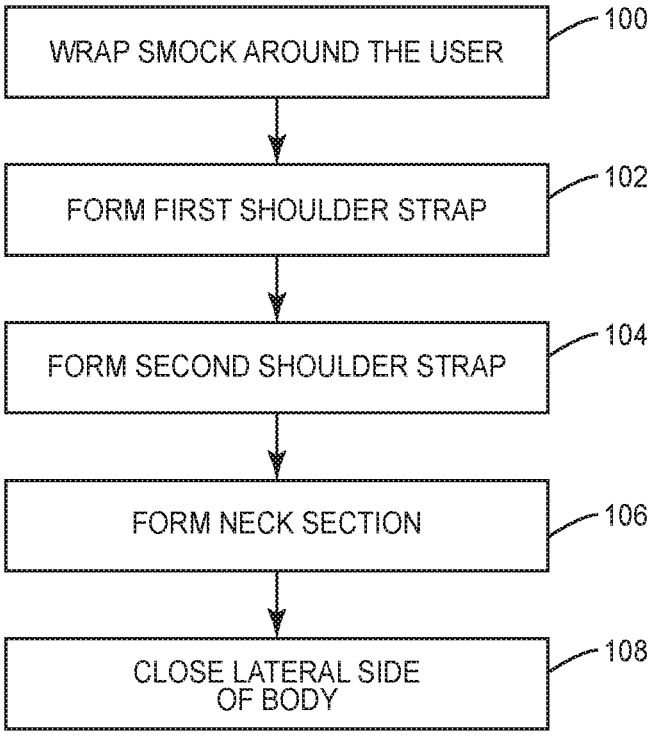
FIG. 13 is a diagram of a method of securing a smock on a user.

The smock 10 can be secured to a user in a variety of different methods. FIG. 13 illustrates one method of securing a smock 10 on a user. The method includes wrapping the smock 10 around the user (block 100). This can include aligning a first section of the body 20 along a front of the user and opposing lateral sides of the body 20 away from the front of the user. A first tab 30 can be engaged in a first receptacle 50 and to form a first shoulder strap along a top side 21 of a body 20 (block 102). A second tab 30 can be engaged into a second receptacle 50 to form a second shoulder strap along the top side 21 of the body 20 (block 104). Forming the shoulder straps encloses the user's head within a neck section 33 that is formed along the top side 21 of the body 20 (block 106). An opening formed between the lateral sides 23, 24 of the body 20 is closed by engaging a third tab 30 into a third receptacle 50 (block 108). This attaches together the first and second lateral sides 23, 24 and encloses the user within the body 20.

Another method can include the shoulder straps being formed by inserting the tabs 30 into the corresponding receptacles 50. The smock 10 with the formed shoulder straps can then be placed on the user with the user's head fitting into the area formed by the neck sections 32, 33. Alternatively, a single shoulder strap can be formed and then the smock 10 is placed on the user. After placement, the second shoulder strap can be formed on the opposing side of the user's head and neck. In yet another method, the open smock 10 can be placed at the user. The shoulder straps can then be formed around the user's head and neck.

Another method is directed to using a smock 10. The flexible body of the smock is wrapped around a user. To secure the smock 10, a tab 40 is aligned with a receptacle 50. A first force is applied to the tab 40 to insert the tab 40 into the receptacle 50 with a wing 43 on the tab 40 moving through the receptacle 50. The tab 40 forms a strap along one side of the body 20 and secures the body 20 to the user. While being worn by the user, a second force is applied to the tab 40 that is greater than the first force. This second force causes a back of the wing 43 to contact against a back of the receptacle 50 and prevents the tab 40 from being removed from the receptacle 50. While being worn by the, a third force is applied to the tab 40 that is greater than the second force. The third force causes the wing 43 to deform wing 43 and pulls the tab 40 out of the receptacle 50 and disconnects the tab 40 from the receptacle 50.

The methods can also include securing the one or more lateral tabs 30 with the corresponding receptacles 50. The lateral tabs 30 can be adjusted in size to accommodate the user and prevent removal of the smock 10 from the user.

In another method, the one or more lateral tabs 30 are secured first, followed by the shoulder straps.

In the various methods, the number of wings 43 on the tabs 30 that are inserted through the receptacle 50 will depend upon the size of the user. For a smaller user, a greater number of wings 43 may be inserted through the receptacle 50 thus shortening the length. For a larger user, fewer wings 43 may be inserted through the receptacle 50.

In one example, to remove the smock 10, the tabs 30 are reduced in width by applying an inward force towards the center line C/L. Once reduced, the tabs 30 can be removed from the receptacles 50.

The design of the smock 10 provides for a secure attachment on the user. In the event a user was to attempt to use the smock 10 to injure themselves or another (e.g., insert their head into the neck opening in an attempt to strangle themselves), the force applied to the smock 10 would cause the wings 43 to fold inward and release from the receptacles 50.

In one design, the tabs 30 are a single ply. In another design, the tabs 30 include a first ply that is the same as the main body of smock 10. A second ply is attached to the tabs 30 and stitched together.

In another example, the smock 10 includes a pair of shoulder straps. A first one of the shoulder straps includes a fixed construction that is not adjustable. A second one of the shoulder straps is formed by a tab 40 and corresponding receptacle 50. In use, the second shoulder strap is opened. The smock 10 is then placed over the user with the fixed shoulder strap placed on one of the user's shoulders. Once positioned, the second shoulder strap is formed by inserting the tab 40 into the receptacle 50.

Spatially relative terms such as "under", "below", "lower", "over", "upper", and the like, are used for ease of description to explain the positioning of one element relative to a second element. These terms are intended to encompass different orientations of the device in addition to different orientations than those depicted in the figures. Further, terms such as "first", "second", and the like, are also used to describe various elements, regions, sections, etc. and are also not intended to be limiting. Like terms refer to like elements throughout the description.

As used herein, the terms "having", "containing", "including", "comprising" and the like are open ended terms that indicate the presence of stated elements or features, but do not preclude additional elements or features. The articles "a", "an" and "the" are intended to include the plural as well as the singular, unless the context clearly indicates otherwise.

The present invention may be carried out in other specific ways than those herein set forth without departing from the scope and essential characteristics of the invention. The present embodiments are, therefore, to be considered in all respects as illustrative and not restrictive.

The invention claimed is:

1. A smock for use in institutional facilities, the smock comprising:

a body comprising a top side, an opposing bottom side, and lateral sides;

one or more tab and receptacle combinations that form one or more shoulder straps along the top side of the body and each comprise:

a tab that extends outward from the body at the top side and that comprises an arm and a wing that extends outward from the arm, the tab having a first size at the wing and a second size away from the wing with the tab and the body comprising a unitary construction;

a receptacle positioned at the top side of the body and sized to receive the tab and being positioned on an opposing part of the body from the tab with the receptacle having an elongated shape with a major axis that extends along the top side of the body;

wherein the wing is a first wing and the tab further comprises one or more additional wings spaced apart in a non-overlapping arrangement along a length of the tab with each sized greater than the receptacle.

2. The smock of claim 1, wherein the wing includes a first section that extends outward from a first side of the arm and a second section that extends outward from an opposing second side of the arm, wherein each of the first section and the second section comprises a common shape and size and the wing is symmetrical about a centerline of the arm.

3. The smock of claim 1, wherein the wing comprises a tapered shape that requires a first amount of force to be inserted into the receptacle and a greater second amount of force to be removed from the receptacle.

4. The smock of claim 1, wherein the body comprises first and second sections that are connected together along a seam.

5. The smock of claim 1, wherein the smock is flat in an open orientation.

6. The smock of claim 1, further comprising a fixed shoulder strap positioned at the top side of the body, the fixed shoulder strap being non-adjustable and the tab and receptacle combinations comprise a series of receptacles that are aligned in a row.

7. The smock of claim 1, wherein the tab comprises a leading edge and a trailing edge, with the trailing edge being straight and exposed along the arm.

8. The smock of claim 7, wherein the trailing edge is perpendicular to a centerline of the arm.

9. The smock of claim 1, wherein the body and the arm are constructed from two pieces of material that are fixedly attached together with an intermediate batting.

10. A smock for use in institutional facilities, the smock comprising:

a body with a top side, a bottom side, and lateral sides;

one or more tabs that extend from the body and that each comprise an arm and one or more wings that extend laterally outward from the arm, the wings comprising a tapered shape with a tapered outer edge that extends from a tip to a back side and with the back side intersecting at corners at the arm;

the body and the one or more tabs comprising a unitary construction;

one or more receptacles positioned at the body and each being sized to receive one of the tabs;

the tabs configured to require a first amount of force to be inserted into the receptacles and a second amount of force to be removed from the receptacles, the second amount of force being greater than or equal to the first amount of force.

11. The smock of claim 10, wherein the smock is selectively positionable between a first orientation when not worn by a user and a second orientation when worn by the user;

the first orientation comprising a flat shape with the one or more tabs positioned away from the one or more receptacles; and the second orientation comprising a first one of the tabs inserted into a first one of the receptacles to form a first shoulder strap, a second one of the tabs inserted into a second one of the receptacles to form a second shoulder strap, and a third one of the tabs inserted into a third one of the receptacles to form a lateral strap.

12. The smock of claim 10, wherein the one or more receptacles comprises a width that is greater than the arm and that is less than the one or more wings and with the receptacles aligned in a row that extends inward from an outer edge of the body.

13. A method of using the smock of claim 1, the method comprising:

wrapping the body around a user;

aligning a first one of the tabs with a first one of the receptacles;

applying a first force to the tab and inserting the tab into the receptacle with the wing on the tab moving through the receptacle and the tab forming a strap along and securing the body to the user;

applying a second force to the tab that is less than the first force and contacting the wing against the body at the receptacle and preventing the tab from being removed from the receptacle; and deforming the wing and pulling the tab out of the receptacle and disconnecting the tab from the receptacle.

14. The method of claim 13, further comprising deforming the wing on the tab and reducing a width of the tab while moving the tab through the receptacle.

15. The method of claim 13, further comprising contacting a back edge of the wing against the body at the receptacle and preventing the tab from being removed from the receptacle.

16. The method of claim 13, further comprising aligning the tab with a shoulder of the user and forming a shoulder strap with the tab.

17. The method of claim 13, further comprising:

inserting a second one of the tabs into a second one of the receptacles and forming a second strap along a second side of the body; and inserting a third one of the tabs into a third one of the receptacles and forming a third strap.

* * * * *